United States Patent [19]

Mayers et al.

[11] 4,310,301

[45] Jan. 12, 1982

[54] COMBINATION BURNER AND EXHAUST GAS RECIRCULATION SYSTEM FOR A CARBOTTOM FURNACE

[75] Inventors: Richard R. Mayers, Delta; Dennis A. Chojnacki, Toledo, both of Ohio

[73] Assignee: Midland-Ross Corporation, Cleveland, Ohio

[21] Appl. No.: 208,166

[22] Filed: Nov. 19, 1980

[51] Int. Cl.[3] ..... F27B 9/00

[52] U.S. Cl. ..... 432/121; 432/152; 432/200; 432/241

[58] Field of Search ..... 432/121, 152, 200, 241

[56] References Cited

U.S. PATENT DOCUMENTS 3,920,382 11/1975 Hovis et al. ..... 432/152
4,083,677 4/1978 Hovis ..... 432/19
4,235,591 11/1980 Aebli ..... 432/152

FOREIGN PATENT DOCUMENTS 603904 6/1948 United Kingdom ..... 432/152

*Primary Examiner*—John J. Camby
*Attorney, Agent, or Firm*—Harlan E. Hummer

[57] ABSTRACT

A carbottom furnace is described as having high velocity or high momentum-type stoichiometric burners, rather than excess air-type burners. Hot exhaust gas, removed from the furnace, is recirculated immediately back to the heat treatment chamber of the furnace, without reheating, in a manner which compliments and reinforces the swirling flow of gas created in the chamber by the high momentum burners. This recirculation of exhaust gas is especially useful during normal turndown of the burners to maintain sufficient volume of heated gas within the chamber to properly heat treat the articles or workpieces which are positioned within the chamber.

7 Claims, 2 Drawing Figures

COMBINATION BURNER AND EXHAUST GAS RECIRCULATION SYSTEM FOR A CARBOTTOM FURNACE

BACKGROUND OF THE INVENTION

The invention relates to furnaces, especially carbottom furnaces, wherein a car for supporting articles to be heat treated, is movable along a trackway into the furnace and provides the bottom of the heat treatment chamber of the furnace that normally uses excess air burners. Such furnaces are operated in temperature ranges of, for example, 700° F.-1800° F. and require excessive amounts of heated air in the heat treatment process, but such excess air creates problems. For example, a great deal of energy is required to heat such excess air.

U.S. Pat. No. 4,083,677 recognizes the problems of using excessive amounts of air, and replaces the normally required large number of excess air burners with substantially fewer high velocity or high momentum-type burners that are operated in complete stoichiometric ratio of combustion air to fuel, to optimize fuel efficiency. High momentum burners are capable of providing the equivalent circulation of large quantities of excess hot gas necessary in the aforementioned heat treatment process, until the burners are turned down as the temperatures of the articles, to be treated, approach the desired level. The '677 patent solves this loss of air during burner turndown by circulating excess air into the heat treatment chamber through perforations in the burner block. It can be appreciated that this particular system is still energy inefficient because the high momentum burners become, in essence during turndown, excess air burners wherein energy is still required to heat the excess air.

This invention is designed to produce a more energy efficient system by utilizing the normally wasted hot exhaust gas, created during the heat treatment process, as a source of heated excess gas that is supplied to the chamber during high fire and turndown of the high momentum burners.

Briefly stated, the invention is in a furnace that has a heat treatment chamber that is sealable from the ambient atmosphere. Means are provided for transporting workpieces or articles, to be heat treated, into and out of the chamber. A plurality of fuel efficient high velocity or high momentum-type stoichiometric burners are mounted on the furnace to circulate hot gaseous products of combustion into the chamber in a desired flow pattern to produce the most uniform gas temperatures within the chamber. Means are provided for removing hot exhaust gas from the chamber and recirculating it immediately, without reheating, back to the chamber in a way that compliments and reinforces the flow of hot gases of combustion in the chamber, to optimize the heat treatment of the articles placed within the chamber, especially during turndown of the burners. Also, there is a substantial reduction in the fuel required, because of the efficient use of the recirculated exhaust gas.

DESCRIPTION OF THE DRAWING

The following description of the invention will be better understood by having reference to the accompanying drawing, wherein.

ENVIRONMENT OF THE INVENTION

Figure 1:
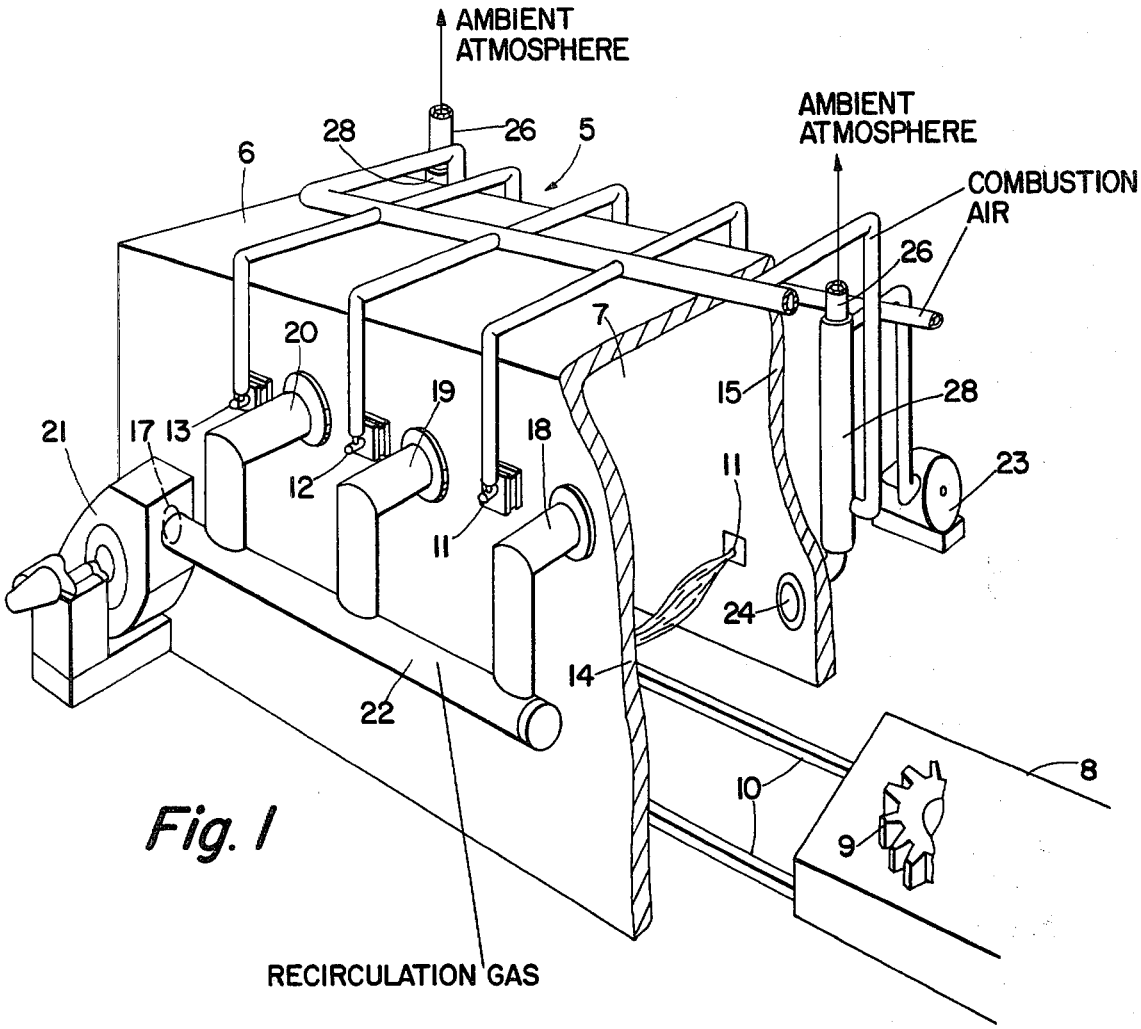
FIG. 1 is a perspective view of a carbottom furnace which is made in accordance with the invention.

With reference to the drawing, especially FIG. 1, there is shown a carbottom furnace 5 which essentially comprises: a thermally insulated housing 6 in which is formed a heat treatment chamber 7 that is sealable from the ambient atmosphere; and a car 8 which is used for supporting articles of a load to be heat treated, e.g. gear 9, and which is movable along a fixed trackway 10 that extends longitudinally of the chamber 7. The car 8 acts as the bottom of the chamber 7 when properly positioned within the furnace 5 and one or more open ends of the furnace are closed, so that the chamber 7 is sealed from the ambient atmosphere.

Depending on the size or particular design of the furnace, one or more of a plurality of rows of similar, high velocity or high momentum-type stoichiometric burners 11–13 are mounted on the furnace 5 to produce within the chamber 7, a desired volume of hot gaseous products of combustion that are caused to flow in a pattern which produces the most uniform gas temperatures throughout the chamber 7. In the embodiment of FIG. 1, two rows of high momentum burners 11–13 are positioned diagonally opposite each other in the vertical sidewalls 14,15 of the furnace 5, adjacent the top and bottom of the furnace 5, to produce, as best seen in FIG. 2, a generally spirally or swirling pattern or flow of gas about the longitudinal axis of the chamber 7, when the chamber is free of articles or workpieces that can obstruct such ideal flow.

Figure 2:
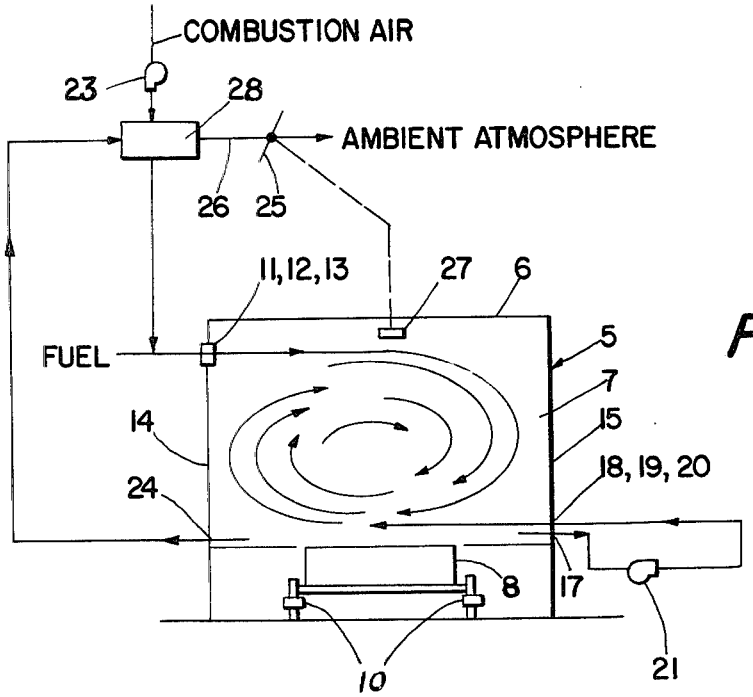
FIG. 2 is a schematic illustration of another furnace, and is primarily designed to show the most desireable flow pattern of gas within the heat treatment chamber of the furnace.

In the embodiment of FIG. 2, the high momentum burners 11–13 are placed in a single row which is located in only one of the sidewalls adjacent the top of the furnace 5. In both cases, however, the burners 11–13 are horizontally aligned in rows and spaced along an axis or axes which are parallel to the longitudinal axis of the chamber 7.

THE INVENTION

Any suitable means are provided to continuously remove hot gaseous products of combustion from the chamber 7 and immediately recirculate such products back to the chamber 7 to reinforce and compliment the flow of hot gaseous products of combustion from the high momentum burners 11–13. For example, one or a plurality of strategically situated outlets 17 are provided in the chamber 7, so that such gaseous products can be continuously removed from the chamber 7 and returned immediately thereto, under pressure and without reheating, through a plurality of inlets 18–20 which are located to direct a plurality of streams of hot recirculation gas into the chamber 7 to combine with the flow of hot gaseous products of combustion from the high momentum burners 11–13 in the production of the swirling pattern of gas which effectively heats the load positioned within the chamber 7.

More particularly, in the embodiment of FIG. 1, a gas outlet 17 is provided adjacent one end of the chamber 7 opposite the vertically lowermost row of high momentum burners 11–13, in a place where the removal of gas will not interfere or cause minimal interference with the swirling pattern of gas within the chamber 7. Gas inlets 18–20 are alternately positioned in the vertically uppermost row of high momentum burners 11–13.

In the embodiment of FIG. 2, gas inlets 18–20 take the place of the vertically lowermost row of high momentum burners 11–13 of FIG. 1. It can be readily appreciated that in both cases, the gas inlets 18–20 are positioned so that the flow of hot recirculation gas into the chamber, compliments and reinforces the flow of the hot gaseous products of combustion from the high momentum burners 11–13.

A high temperature fan 21 is mounted adjacent, and in communication with, the gas outlet 17, to remove hot gas from the chamber 7 and recirculate it immediately, under pressure and without reheating, to the chamber 7 through a main feed pipe 22 which connects the gas inlets 18–20 with the fan 21.

A combustion air blower 23 is used to circulate combustion air to the high momentum burners for admixture with fuel that is being supplied to the burners from any suitable source of supply.

The gas outlet 17 and the gas inlets 18–20 are sufficiently large and suitably sized to provide adequate amounts of heated recirculation gas to aid the high momentum burners in the proper heat treatment of the load placed in the furnace 5, especially during turndown of the high momentum burners 11–13. The recirculation system of hot gas is designed in combination with the high momentum burners 11–13 to provide the equivalent circulation that is normally supplied in such furnaces when comparable conventional excess air burners are used.

Any suitable means can be used to permanently exhaust, and not recirculate, gas from the chamber 7 in correlated relation to the hot gaseous products of combustion being circulated to the chamber 7 by the high momentum burners 11–13, to maintain the furnace, in balance. For example, one or a plurality of exhaust ports 24, depending on the volume of gas required to be exhausted from the furnace, are strategically located in the chamber 7 to allow the continuous removal of exhaust gas with minimal interference with the pattern of swirling gas within the chamber 7. The exhaustion of gas from the chamber 7 is regulated to maintain a desired gas pressure within the chamber 7 of the furnace 5 by any appropriate means, as best seen in FIG. 2, e.g. a pressure control damper 25 disposed in a flue pipe or stack 26 which extends from an exhaust port 24 and through which exhaust gas is discharged into the ambient atmosphere, the position of the damper being controlled by means of a pressure sensing device 27 that monitors the gas pressure within the chamber 7.

Any suitable recuperator 28 can be provided to preheat the combustion air, if it is desired to capture some of the heating energy of the exhaust gas. In such cases, exhaust gas, normally discharged through a flue pipe or stack into the ambient atmosphere to maintain the system in balance, is first circulated through the recuperator 28 in heat exchanging relation with cooler combustion air to preheat the combustion air, prior to the mixture of the combustion air with the fuel that is being supplied to the high momentum burners. In this way, a portion of the heating energy of the discarded exhaust gas is utilized in the preheating of the combustion air to make the system even more energy efficient.

Thus, there has been described, a unique furnace, especially of the carbottom type furnace, in which hot gas removed from the heat treatment chamber is utilized to aid high momentum burners in the provision of the heated gas required in the heat treatment process, especially during normal turndown of the high momentum burners when the load to be treated is approaching the desired temperature level.

What is claimed is:

1. A furnace, comprising:

(a) a housing having a pair of opposing, vertically disposed sidewalls which extend between a top and bottom of the furnace and which define a chamber that has a longitudinal axis and is sealable from the ambient atmosphere;

(b) means for moving an article to be heat treated, into and out of the chamber;

(c) a plurality of high velocity or high momentum-type stoichiometric burners strategically mounted on the furnace to circulate hot gaseous products of combustion, under pressure and at a high velocity, into the chamber to provide within the chamber, at least a portion of the desired amount of heated gas to properly heat treat articles placed in the chamber;

(d) means mounting the burners in at least one horizontally aligned row in at least one of the sidewalls vertically above the longitudinal axis of the chamber adjacent the top of the furnace for directing hot gaseous products of combustion in a generally horizontally direction into the chamber;

(e) means for removing gas from the chamber and recirculating at least a portion of such gas directly into the chamber without reheating it, to maintain the desired heated atmosphere within the chamber, especially during turndown of the burners, said means including at least one horizontally aligned row of gas inlets in an opposing sidewall diagonally opposite the row of burners and vertically below the longitudinal axis of the chamber adjacent the bottom of the furnace for directing said recirculated portion of gas back into the chamber in a generally horizontal direction, the burners and inlets being positioned so that gas therefrom generally swirls in the chamber about the longitudinal axis thereof; and (f) means for exhausting gas from the chamber vertically below the longitudinal axis thereof adjacent the bottom of the furnace.

2. The furnace of claim 1, wherein the gas removing and recirculating means includes means for recirculating gas to the chamber such that the flow of recirculation gas compliments and reinforces the flow of gas from the burners.

3. The furnace of claim 2, wherein the means for mounting the burners includes, means for positioning two rows of burners diagonally opposite each other in opposing vertical sidewalls of the furnace, each row of burners including a plurality of burners which are spaced along an axis that is parallel to the longitudinal axis of the chamber.

4. The furnace of claim 3, wherein the gas removing and recirculating means includes means for positioning a row of inlets in coaxial alignment with at least one row of burners so that the inlets and burners in said row are in alternate spaced relationship.

5. The furnace of claim 2, wherein the gas removing and recirculating means includes means for positioning a plurality of gas inlets in a single row that is diagonally opposite a single row of burners.

6. The furnace of claims 1, 4 or 5 which includes means for recuperating at least some of the heat energy from the gas being exhausted to preheat combustion air, prior to mixture of the air with fuel being supplied to the burners.

7. The furnace of claims 1, 4 or 5 wherein the article moving means includes, a fixed trackway extending longitudinally of the chamber, and a car movable along the trackway and providing the bottom of the chamber when the car is properly positioned within the chamber, so that the chamber can be sealed from the ambient atmosphere.

* * * * *